United States Patent [19]

Kishi et al.

[11] Patent Number: 4,579,802

[45] Date of Patent: Apr. 1, 1986

[54] METHOD OF FIXING TONER IMAGE

[75] Inventors: Ken-ichi Kishi, Sagamihara; Jiro Takahashi, Hachioji; Meizo Shirose, Hino; Kenzi Tuzita, Fujino; Takahira Kasuya, Hachioji, all of Japan

[73] Assignee: Konishiroku Photo Industry Co. Ltd., Tokyo, Japan

[21] Appl. No.: 529,350

[22] Filed: Sep. 6, 1983

[30] Foreign Application Priority Data

Sep. 14, 1982 [JP] Japan ..... 57-158787
Sep. 14, 1982 [JP] Japan ..... 57-158788
Sep. 14, 1982 [JP] Japan ..... 57-158789
Sep. 14, 1982 [JP] Japan ..... 158790

[51] Int. Cl.[4] ..... G03G 13/20; G03G 13/22

[52] U.S. Cl. ..... 430/99; 430/125; 118/60; 355/3 FU; 134/1; 134/42

[58] Field of Search ..... 430/98, 99, 124, 125; 118/60, 114, 116; 355/3 FU; 219/469; 432/60, 228; 134/1, 42

[56] References Cited

U.S. PATENT DOCUMENTS 3,938,992 2/1976 Jadwin et al. ..... 430/124 X
3,964,431 6/1976 Namiki ..... 432/60 X
4,185,140 1/1980 Strella et al. ..... 355/3 FU

FOREIGN PATENT DOCUMENTS 55-135853 10/1980 Japan ..... 430/98
1434089 4/1976 United Kingdom ..... 355/3 FU

OTHER PUBLICATIONS

Hoffend et al., "Polymer Blends as Release Agents for Bare Metal Fusers in Electrostatic Copiers", Xerox Discl. Jour., vol. 3, No. 3, May/Jun. 1978, pp. 155-157.

*Primary Examiner*—Roland E. Martin
*Attorney, Agent, or Firm*—James E. Nilles

[57] ABSTRACT

A method of fixing a toner image on a supporting member by bringing the supporting member supporting thereon the toner image into pressure contact with a fixing roller, wherein an elasticity improving agent for increasing the elasticity of the toner upon coming into contact with the toner is disposed on a member which comes into direct or indirect contact with the outer circumferential surface of the fixing roller.

The elasticity improving agent is a material causing the reaction which increases the molecular weight of the binder resin of the binder and/or a reaction promoter for such a reaction.

The elasticity improving agent is selected from a group consisting of:

(a) agents which are capable of enhancing the elasticity of toner material,
(b) polyhydric alcohols,
(c) polyvalent amines and
(d) polyvalent carboxylic acids.

9 Claims, 3 Drawing Figures

METHOD OF FIXING TONER IMAGE

BACKGROUND OF THE INVENTION

1. Field of the Invention

This invention relates to a method of fixing a toner image, which is formed on a supporting member by developing a latent image formed by an electrophotographic method, an electrostatic printing method or the like by a toner, on the supporting member.

2. Description of the Prior Art

A variety of fixing apparatuses have been proposed in the past to fix the toner image. Among them, a contact heating type fixing apparatus consisting, for example, of a rotatable fixing heat roller with a built-in heat source and a pressure contact roller rotating in the same direction as the heat roller while keeping contact with the heat roller has gained a wide practical application because the apparatus can provide a high heat efficiency but is free from the risk of fire.

Though the contact heat fixing system is preferable in various aspects as described above, it involves the problem that the toner attaches to the heat roller and then attaches once again to the subsequent supporting member supporting thereon the toner image to contaminate the fixed image. Accordingly, the toner attaching to the heat roller must be cleaned by use of cleaning members such as cleaning webs, cleaning blades, cleaning rollers, and the like.

When these cleaning members are disposed, however, so-called "back contamination" occurs. When excessive heat is applied to the toner material deposited on the cleaning member, the toner material is transferred to the heat roller, then contaminates the surface of the supporting member such as transfer paper that is subsequently fed, is further transferred to the pressure contact roller that is contacted to the heat roller and thus contaminates the back of the supporting member.

The inventors of the present invention have examined the cause of occurrence of this back contamination and have found that the elasticity of the toner at the time of fusing plays an important role. A thermoplastic resin consisting principally of a styrene-acrylic copolymer or a polyester resin has been believed preferable conventionally as a binder resin of the toner because it has a low softening point and provides high fixability. The elasticity improving compound is presented on the circumferential surface of the fixing roller other than at a point where the fixing roller is in press contact with the toner image supporting member. When fused, however, the resin has low elasticity and hence, is likely to transfer. Even though the resin is once collected by the cleaning member, therefore, the resin deposited on the cleaning member transfers to the heat roller when heated to a temperature which is by 10° to 60° C. higher than the set temperature of the heat roller after the heater of the heat roller is actuated, and eventually causes back contamination. If the elasticity of the toner at the time of fusing is adjusted in advance lest back contamination occurs, fixability drops and fixing can not be effected sufficiently.

SUMMARY OF THE INVENTION

With the background described above, the present invention is directed to provide a method of fixing a toner which does not involve back contamination.

In a method of fixing a toner image on a supporting member by bringing the supporting member supporting thereon the toner image into pressure contact with a fixing roller, the object of the present invention can be accomplished by a method of fixing the toner image characterized in that an elasticity improving agent is disposed on a member which comes into direct or indirect contact with the outer circumferential surface of the fixing roller in order to increase the elasticity of the toner material when the member comes into contact with the toner.

In a method of fixing a toner image on a supporting member by bringing the supporting member supporting thereon the toner image into pressure contact with a fixing roller, the object of the invention described above can also be accomplished by a fixing method of the toner characterized in that at least a polyhydric alcohol is disposed on a member which comes into direct or indirect contact with the outer circumferential surface of the fixing roller.

In a method of fixing a toner image on a supporting member by bringing the supporting member supporting thereon the toner image into pressure contact with a fixing roller, the object of the invention can also be accomplished by a fixing method characterized in that at least a polyvalent amine is disposed on a member which comes into direct or indirect contact with the outer circumferential surface of the fixing roller.

In a method of fixing a toner image on a supporting member by bringing the supporting member supporting thereon the toner image into pressure contact with a fixing roller, the object of the invention can be further accomplished by a fixing method characterized in that at least a polyvalent carboxylic acid is disposed on a member which comes into direct or indirect contact with the outer circumferential surface of the fixing roller.

DESCRIPTION OF THE PREFERRED EMBODIMENTS

In a fixing device equipped with a fixing heat roller for fixing a toner image on its supporting member of the present invention, an elasticity improving agent, which increases the elasticity of the materials forming the toner when they are fused, is disposed on a cleaning member which is arranged so as to come into direct or indirect contact with the outer circumferential surface of the fixing heat roller, and the supporting member is fed under such a state to the fixing device. More definitely, the elasticity improving agent is one that reacts with the resin constituting the binder resin of the toner and increases its molecular weight and/or a reaction promoter which promotes such a reaction.

The elasticity improving agent may be selected in accordance with the materials forming the toner image. If the binder resin is a polymer or copolymer containing as the main monomer component acrylic acid ester that is widely used, for example, preferred examples of the elasticity improving agent are aliphatic amines such as propylamine, butylamine, dodecylamine and the like, quinoline derivatives such as quinoline, quinaldine, leipidine and the like, piperidine and its derivatives, and other basic substances. These compounds can cause the reaction which cross-links the acrylic acid ester portion, so that the molecular weight of the polymer or copolymer increases and the elasticity as the time of fusing can be eventually increased. The reaction promoter in the reaction described above is calcium oxide, steric acid, sulfur, and the like.

It is assumed that the Claisen's condensation of active hydrogen bonded to the $\alpha$-carbon of the acrylic acid portion of the binder resin takes place, though the reaction mechanism is not fully clarified.

The elasticity improving agent has preferably a liquid form as a whole such as a solution, a dispersion or the like while the member which comes into direct or indirect contact with the outer circumferential surface of the heat roller is preferably formed by a liquid supporting member consisting of a porous material or in combination with the liquid supporting member, so that the elasticity improving agent in the liquid form can be impregnated into and held by the liquid supporting member.

Figure 1:
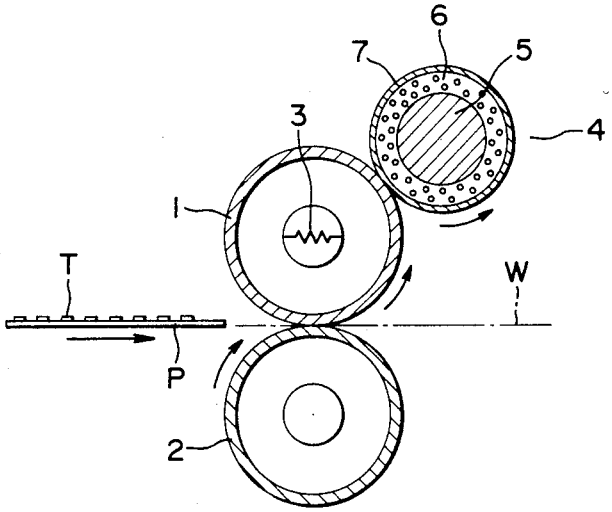
FIGS. 1 through 3 are sectional views, each useful for explaining the construction of a fixing device suitably used for practising the fixing method of the present invention.

A definite example is illustrated in FIG. 1. The fixing device comprises a fixing heat roller 1 consisting of a metal drum equipped with a coating layer of Teflon around its outer circumferential surface, a pressure contact roller 2 consisting of a metal drum equipped with a silicone rubber layer around the outer circumferential surface, and disposed so as to come into pressure contact with the heat roller 1, a heater 3 disposed inside an internal space of the heat roller 1, and a cleaning roller 4 disposed so as to face the heat roller 1 and to follow up the rotation of the heat roller. In this fixing device, a liquid supporting layer 6 consisting of silicone foamed rubber is disposed on the outer circumferential surface of a metal core 5 of the cleaning roller 4 and a surface layer 7 consisting of heat-resistant nylon felt is disposed around the outer circumferential surface of this liquid supporting layer 6. The elasticity improving agent is impregnated into and held by this liquid supporting layer 6. Symbols P, T and W represent a toner image supporting member, a toner, and a supporting member passage, respectively.

When the fixing device having the construction described above is employed, the cleaning roller 4 collects the toner attaching to the heat roller 1 on its outer circumferential surface. Accordingly, the toner material is deposited on this outer circumferential surface. Since the elasticity improving agent oozes out from the internal liquid supporting layer 6 onto the outer circumferential surface of the cleaning roller 4, however, the elasticity of the toner collected by, or the toner material deposited on, this outer circumferential surface is increased at the time of fusing, so that even when the heater 3 of the heat roller 1 is actuated and the toner material on the cleaning roller 4 is heat-fused, it does not transfer onto the heat roller 1 and as a result, onto the pressure contact roller 2. Hence, back contamination can be prevented.

Figure 2:
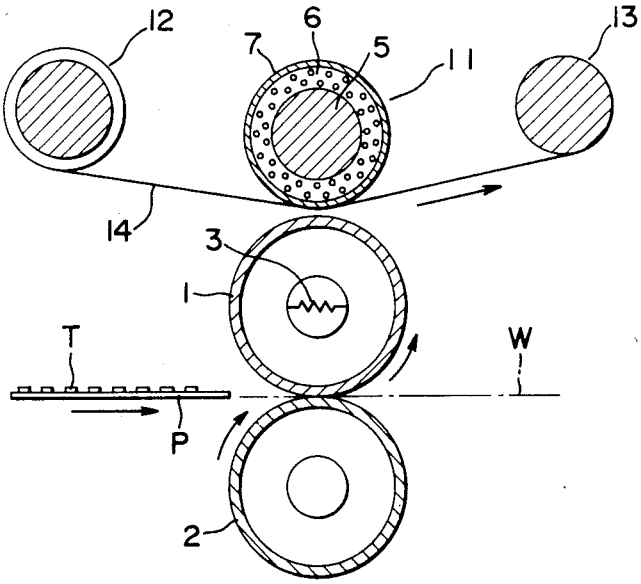

FIG. 2 shows further embodiment in which a liquid feed roller 11 having the same construction as the cleaning roller 4 in FIG. 1 is brought into contact with the heat roller 1 via a cleaning web 14 that is conveyed by rollers 12 and 13. According to this embodiment, the elasticity of the toner material collected and deposited on the cleaning web 14 is increased at the time of fusing, so that the occurrence of back contamination is prevented reliably and at the same time, the service life of the cleaning web 14 can be extended.

Figure 3:
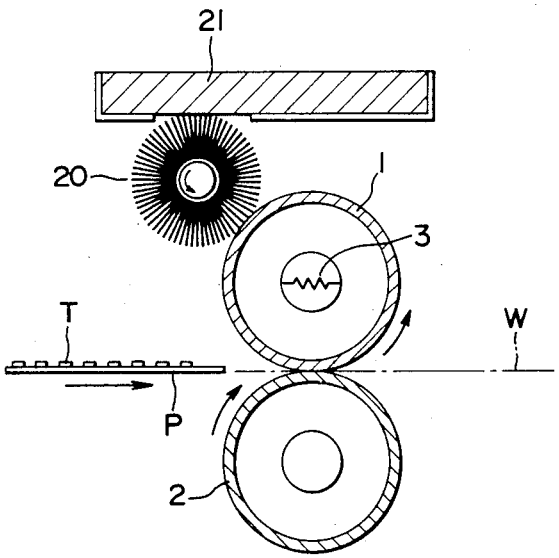

FIG. 3 shows another embodiment which includes a brush type cleaning roller 20. A liquid supporting member 21 is disposed in such a manner as to come into contact with this cleaning roller 20 and the elasticity improving agent is impregnated into the liquid supporting member 21. The same action and effect as that of the embodiment shown in FIG. 1 can also be obtained in this embodiment.

In a method of fixing a toner image by a contact heat system of the present invention, the elasticity of the toner material collected on the cleaning member after attaching to the fixing heat roller is increased at the time of fusing, as described above. Accordingly, the transfer of the toner material to the heat roller that would otherwise occur, does not occur and hence, it does not further transfer to the pressure contact roller, thereby preventing the occurrence of back contamination. As a result, a visible image fixed beautifully can be always obtained. Moreover, it is not necessary to use a binder resin which per se has high elasticity at the time of fusing in order to prevent the occurrence of back contamination. For this reason, the sacrifice of the fixability inherent to the toner can be avoided and an excellent visible image can be formed in this respect, too.

The method of the present invention can be naturally practised by use of an apparatus having a construction other than the apparatus shown. The elasticity improving agent need not always be applied to the cleaning member shown in the drawing but may be applied to other portions. For example, a roller-like member supporting the elasticity improving agent is disposed so as to face and come into contact with the heat roller. In such a case, the member supporting the elasticity improving agent is preferably disposed inside the range of the heat roller upstream of the cleaning range by the cleaning member so that the toner attaching onto the heat roller first comes into contact with the elasticity improving agent and is then cleaned by the cleaning member.

The elasticity improving agent is preferably in the liquid form as a whole, as described previously. In such a case, an appropriate carrier liquid may be used. The carrier liquid is preferably stable to heat. If the carrier liquid has a mold release property, it is applied, even though in a limited quantity, to the surface of the heat roller, too, so that the toner of the toner image to be fixed is prevented from attaching to the heat roller. From this aspect, the carrier liquid is preferably silicone oil. The proportion of the carrier liquid such as silicone oil to the elasticity improving agent varies depending upon conditions, but it is selected from the range of 1:99 to 99:1 and is generally from 95 to 50:5 to 50.

Hereinafter, test examples of the present invention will be described.

TEST EXAMPLE 1

The fixing device of an electrophotographic reproducing machine, "U-Bix V" (a product of Konishiroku Photo Industry Co., Ltd.) was modified into the construction shown in FIG. 1. Silicone oil containing 10 wt% of diaza-bicyclo-undecene and 10 wt% of stearic acid was impregnated into a liquid supporting layer of its cleaning roller. Copying tests were carried out 5,000 times using a developer consisting of a toner using a styrene-butyl acrylate copolymer as the binder.

Scarcely any contamination was observed on both surfaces of the resulting 5,000 copies. After the copying tests, the toner material on the cleaning roller was found solidified.

In contrast, tests were also carried out in the same way except that silicone oil alone was impregnated into the liquid supporting layer of the cleaning roller. Contamination was found on the back of copies from about 3,000th copies.

TEST EXAMPLE 2

Copying tests were carried out in the same way as in Test Example 1 except that silicone oil contained 10 wt% of dodecylamine and the toner was a mixture containing 10 wt% of stearic acid. Satisfactory results could be obtained in the same way as in Test Example 1.

By contrast, when silicone oil not containing dodecylamine was used, back contamination was found from about 3,000th copies.

In a fixing device equipped with a fixing heat roller for fixing a toner image on a supporting member of another embodiment of the present invention, at least a polyhydric alcohol is disposed on a member such as a cleaning member which is arranged so as to come into direct or indirect contact with the outer circumferential surface of the heat roller, and the supporting member under such a state is fed into the fixing device to fix the toner image supported by the supporting member. The fixing temperature is preferably from 130° to 230° C.

In accordance with the method described above, so-called ester exchange is caused by the polyhydric alcohol at the ester portion of the binder resin of the toner such as the ester portion of a styrene-acrylic acid ester type copolymer, as represented by the following reaction formula, so that the molecules of the binder resin mutually form a cross-linked structure.

Due to the cross-linking reaction described above, the elasticity of the toner material collected by the cleaning member is increased at the time of fusing. Even when it is heated by the fixing heat roller to a temperature higher than the fixing temperature, therefore, the toner material is preventing from transferring to the heat roller and hence, further to the pressure contact roller and the occurrence of back contamination can be sufficiently prevented.

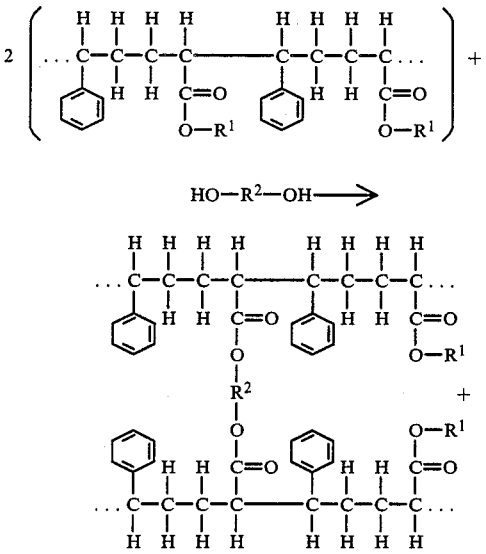

-continued $2\ R^1—OH$ (where $R^1$ is a group forming the ester bond in the acrylic acid ester and $R^2$ is a bond group in the dihydric alcohol.)

Examples of the polyhydric alcohols are ethylene glycol, diethylene glycol, triethylene glycol, tetraethylene glycol, 1,2-propylene glycol, 1,3-propylene glycol, 1,4-butanediol, neopentyl glycol, 1,4-butenediol, sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethylbenzene and the like.

The polyhydric alcohol to be used practically is selected in accordance with the kind of the resin that forms the binder resin of the toner. In order to further promote the ester exchange reaction, the polyhydric alcohol has a higher boiling point than the boiling point of the resulting alcohol by the ester exchange reaction between the polyhydric alcohol and the ester portion of the carboxylic acid of the binder resin.

In accordance with the present invention, a reaction promoter is preferably co-present with the polyhydric alcohol at the portion which comes into direct or indirect contact with the outer circumferential surface of the fixing roller, in order to promote the reaction between the binder resin of the toner and the polyhydric alcohol. The reaction promoter can increase the elasticity of the binder resin of the toner within a short period of time. An example of such a reaction promoter is tetra-t-butyl titanic acid ester.

The toner that is suitably used for the method of the present invention is prepared from those resins which consist principally of polymers or copolymers of acrylic acid esters or methacrylic acid esters that are used generally and preferably as the binder of the toner of this kind, such as a resin consisting principally of a styrene-acrylic copolymer. In this styrene-acrylic copolymer, preferred examples of the styrene monomer for the styrene component are styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, and the like.

In the styrene-acrylic copolymer, preferred examples of the acrylic monomer for the acrylic component are α-methylene aliphatic monocarboxylic acid esters such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, diethylaminoethyl methacrylate, and the like; acrylic or methacrylic acid derivatives such as acrylonitrile, methacrylonitrile, acryloamide, and the like; and so forth.

The styrene monomers and the acrylic monomers may be used either alone or in combination, respectively.

If the polyhydric alcohol is liquid, it may be used as such but if it is solid, it must be turned into a liquid form as a whole such as a solution, a dispersion, and the like. The member which comes into direct or indirect contact with the outer circumferential surface of the fixing heat roller is constituted by a liquid supporting member consisting of a porous material or in combination with the liquid supporting member, and the polyhydric alcohol in the liquid form is preferably impregnated into and supported by the liquid supporting member.

In this embodiment, since the polyhydric alcohol oozes out from the internal liquid supporting layer onto the outer circumferential surface of the cleaning roller 4, the elasticity of the toner or toner material collected on the outer circumferential surface is increased at the time of its fusing. As a result, even when the heater 3 of the heat roller 1 is actuated and the toner material on the cleaning roller 4 is heated and fused, the fused toner is prevented from transferring to the heat roller 1 and hence, further to the pressure contact roller 2 and the occurrence of back contamination can be prevented consequently.

Incidentally, the polyhydric alcohol is impregnated into the liquid supporting member.

This embodiment can be practised not only by supplying the polyhydric alcohol to the cleaning member but also by disposing a roller-like member supporting the polyhydric alcohol, for example, so as to face and come into contact with the outer circumferential surface of the fixing heat roller. In such a case, the member supporting the polyhydric alcohol is preferably disposed within the range of the heat roller upstream of the cleaning range by the cleaning member so as to face the heat roller so that the toner attaching to the heat roller comes first into contact with the polyhydric alcohol and is then cleaned by the cleaning member.

As described previously, the polyhydric alcohol is preferably a liquid as a whole, but a suitable carrier liquid can be used in this case. The carrier liquid is preferably stable to heat. If the carrier liquid has a mold release property, it provides the effect of preventing the toner from attaching to the heat roller, because the carrier liquid is supplied also to the surface of the heat roller even though in a limited quantity. From this aspect, silicone oil is preferably used as the carrier liquid. The proportion of the carrier liquid such as silicone oil to the polyhydric alcohol varies depending upon the kind of the binder resin of the toner and is selected from the range of 1:99 to 99:1. It is generally from 95 to 50:5 to 50.

TEST EXAMPLE 3

A modified machine of "U-Bix V", an electrophotographic reproducing machine having a carbon steel fixing roller (a product of Konishiroku Photo Industry Co., Ltd.) was used for the test. Silicone oil containing 10 wt% diethyleneglycol was impregnated to this fixing roller, and copying tests were carried out 3,000 times using a developer prepared from a toner consisting principally of a styrene-acrylic acid ester resin.

As a result, hardly any contamination was observed on both surfaces of the resulting 3,000 copies. The toner material on the cleaning roller after finish of the test was solidified.

By contrast, copying tests were carried out in the same way except that silicone oil alone was impregnated to the fixing roller. Contamination was found on the back of the resulting copies from about 2,000th copies.

TEST EXAMPLE 4

Copying tests were carried out 3,000 times in the same way as in Test Example 3 except that tetraethylene glycol was used in place of diethylene glycol and 5 wt% of tetra-t-butyl titanic acid ester on the basis of tetraethylene glycol was used as the reaction promoter.

As a result, hardly any contamination was observed on both surfaces of the resulting 3,000 copies. The toner material on the cleaning roller after finish of the copying test was solidified.

By contrast, copying tests were carried out in the same way except that silicone oil alone was impregnated to the fixing roller. Contamination was found on the back of the copies from about 2,000th copies.

In a fixing device equipped with a fixing heat roller for fixing a toner image on its supporting member of still another embodiment of the present invention, a polyvalent amine is disposed on a member which comes into direct or indirect contact with the outer circumferential surface of the heat roller, such as a cleaning member, for example, and the supporting member is fed under such a state to the fixing device to fix the toner image supported thereon. In this case, the fixing temperature is preferably from 130° to 230° C.

According to the method described above, socalled ester exchange is caused by the polyvalent amine at the ester portion of the binder resin of the toner, such as the ester portion of the styrene-acrylic acid ester type copolymer, for example, as represented by the following reaction formula, so that the molecules of the binder resin mutually form a cross-linked structure:

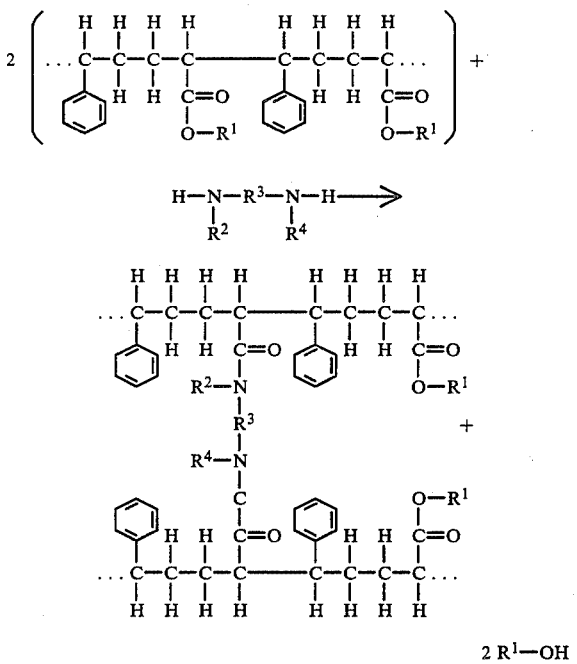

(where $R^1$ is a group forming the ester bond in the acrylic acid ester, $R^2$ and $R^4$ are alkyl groups, allyl groups, hydrogen atoms or the like and $R^3$ is a bond group in the divalent amine.) Due to the cross-linking reaction described above, the elasticity of the toner material collected by the cleaning member increases at the time of fusing, and the toner material is prevented from transferring to the heat roller and hence, further to the pressure contact roller, so that the occurrence of back contamination can be prevented eventually.

Examples of the polyvalent amine are alkylene diamines such as ethylenediamine, propylenediamine, tetramethylenediamine, hexamethylenediamine, and the like; trivalent amines such as 1,2,3-triaminopropane, tris(2-aminoethyl)amine, and the like; bis(aminoalkyl)-substituted products of ammonia such as diethylenetriamine, triethylenetetramine, tetraethylenepentamine, bis(4-aminobutyl)amine, bis(5-aminopentyl)amine, and the like; aromatic diamines such as p-phenylenediamine, m-phenylenediamine, 2,6-diaminonaphthalene, 2,5-diaminopyridine, and the like; divalent amines of cyclic alkanes such as 1,4-diaminocyclohexane, 1,4-bis(aminoethyl) cyclohexane, and the like; and amines such as isopropyl-tris[2-N-(2-aminoethyl)aminoethyl]titanic acid ester, 1,3-[bis(3-aminopropyl)-tetraethoxy]-disiloxane, and the like. The monoalkyl substituted products of the amino groups of the polyvalent amines can also be used in the present invention.

If the polyvalent amine is liquid, it can be used as such. If it is solid, it is preferred that the amine is changed into a liquid as a whole such as a solution, a dispersion or the like, the member which comes into direct or indirect contact with the outer circumferential surface of the fixing heat roller is constituted by a liquid supporting member consisting of a porous material or in combination with the liquid supporting member, and the polyvalent amine in the liquid form is impregnated into the liquid supporting member.

In this embodiment, since the polyvalent amine oozes out from the internal liquid supporting member to the outer circumferential surface of the cleaning roller 4, the elasticity of the toner collected on the outer circumferential surface or the toner material deposited on it is increased at the time of fusing, so that even when the heater 3 of the heat roller 1 is actuated and the toner material on the cleaning roller 4 is heat-fused, the toner material is prevented from transferring to the heat roller 1 and hence, further to the pressure contact roller 2 and the occurrence of back contamination can be prevented.

Incidentally, the polyvalent amine is impregnated to the liquid supporting member.

This embodiment can be practised not only by supplying the polyvalent amine to the cleaning member but also by disposing a roller-like member supporting the polyvalent amine so as to face and come into contact with the outer circumferential surface of the fixing heat roller. In such a case, it is preferred that the member supporting the polyvalent amine is disposed in the range of the heat roller upstream of the cleaning range by the cleaning member so that the toner attaching onto the heat roller first comes into contact with the polyvalent amine and is then cleaned by the cleaning member.

As described above, it is preferred to use the polyvalent amine which is liquid as a whole. In this case, however, a suitable carrier liquid may be used and this carrier liquid is preferably stable to heat. If the carrier liquid has a mold release property, the effect of restricting the toner of the toner image to be fixed from attaching to the heat roller can be obtained because the carrier liquid is supplied also to the surface of the fixing heat roller, even though in a limited quantity. From this aspect, silicone oil is preferably used as the carrier liquid. The proportion of the carrier liquid such as silicone oil to the polyvalent amine varies depending upon the kind of the binder resin of the toner, but is selcted from the range of 1:99 to 99:1 and is generally from 95 to 50:5 to 50.

TEST EXAMPLE 5

A modified machine of an electrophotographic reproducing machine, "U-Bix $V_3$" (a product of Konishiroku Photo Industry Co., Ltd.) having a steel fixing roller was used for the test. Silicone oil containing 10 wt% of 1,3-[bis(3-aminopropyl)-tetraethoxy]-disiloxane was impregnated to the cleaning roller, and copying tests were carried out 5,000 times using a one-component system developer composed of a toner consisting principally of a styrene-acrylic acid ester resin.

As a result, hardly any contamination was observed on both surfaces of the resulting 5,000 copies. The toner material on the cleaning roller was solidified after finish of the copying tests.

By contrast, copying tests were carried out in the same way as above except that silicone oil alone was impregnated to the cleaning roller. Back contamination was found on the copies from about 2,000th copies.

TEST EXAMPLE 6

Copying tests were carried out 5,000 times in the same way as in Test Example 5 except that diethylenetriamine was used in place of 1,3-[bis(3-aminopropyl)-tetraethoxy]-disiloxane.

As a result, hardly any contamination was observed on both surfaces of the resulting 5,000 copies. The toner material on the cleaning roller was solidified after finish of the copying tests.

By contrast, copying tests were carried out in the same way except that silicone oil alone was impregnated to the cleaning roller. Back contamination was found on the copies from about 2,000th copies.

In a fixing device equipped with a fixing heat roller for fixing a toner image on its supporting member of still another embodiment of the present invention at least a polyvalent carboxylic acid is disposed on a member disposed so as to come into direct or indirect contact with the outer circumferential surface of the heat roller, and the supporting member is fed under such a state to the fixing device to fix the toner image supported by the supporting member. In this case, the fixing temperature is preferably from 130° to 230° C.

According to this method, if the resin forming the binder resin of the toner is a polyester resin, for example, the reactions represented by the following reaction formulas [I], [II] and [III] take place, so that the molecular weight of the polyester resin increases. In the following reaction formula [I], the —OH group at the terminal of the polyester resin causes ester bond with one of the —COOH groups of the polyvalent carboxylic acid and the —OH group at the terminal of one other molecule of the polyester resin causes ester bond with the other —COOH group of the polyvalent carboxylic acid, thereby causing the cross-linkage between the molecules of the polyester resin and increasing its molecular weight. In the following reaction formula [II], the condensed divalent carboxylic acid portion of the formula

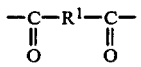

causes the substitution reaction with the divalent carboxylic acid portion as an example of the polyvalent carboxylic acid, having the following formula, due to the heat of the fixing heat roller: the portion

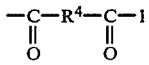

of the divalent carboxylic acid HOOC—$R^4$—COOH. If the divalent carboxylic acid is selected in advance so that the molecular weight of $R^4$ is greater than of $R^1$, the molecular weight of the polyester resin after the substitution reaction increases. In the following reaction formula [III], the polyvalent carboxylic acid participating in the substitution reaction of the reaction formula [II] is a polyvalent carboxylic acid of three valence or more, and the remaining —COOH group or groups that have not participated in the substitution reaction cause ester bond with the —OH group at the terminal of other molecule of the polyester resin, so that the molecules of the polyester resin cause mutual cross-linkage and the molecular weight increases.

Since the molecular weight of the polyester resin increases as described above, the elasticity of the toner material collected by the cleaning member increases at the time of fusing. Accordingly, even if the toner material is heated to a temperature higher than the fixing temperature by the fixing heat roller, the toner material is prevented from transferring to the heat roller and hence, further to the pressure contact roller, and the occurrence of back contamination can be prevented.

Reaction formula [I]:

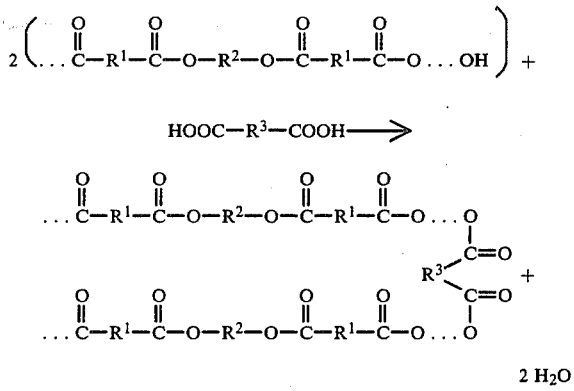

Reaction formula [II]:

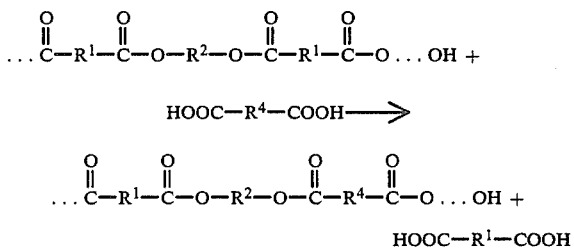

-continued

Reaction formula [III]:

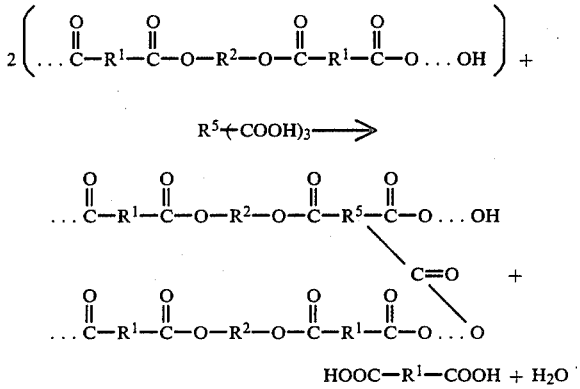

(where $R^1$ and $R^2$ are bond group of the carboxylic acid portion forming the polyester resin and bond group of alcohol portion, respectively, and $R^3$, $R^4$ and $R^5$ are bond groups of the polyvalent carboxylic acid, respectively, and more definitely, they are the portion of the polyvalent carboxylic acid other than the —COOH groups as will be described later.)

Examples of the polyvalent carboxylic acid are the same as those of the carboxylic acids used for forming the polyester resin.

The polyvalent carboxylic acid is selected in accordance with the kind of the polyester resin forming the binder resin of the toner. When the polyvalent carboxylic acid is a divalent carboxylic acid (dicarboxylic acid), for example, a polyvalent carboxylic acid having a molecular weight greater than that of the carboxylic acid portion of the polyester resin to be subjected to the substitution reaction is selected.

Examples of the toner suitably used for practising the method of the present invention are those whose binder resin is composed of resins consisting principally of a polyester resin. This polyester resin is prepared by polycondensation of an alcohol with a carboxylic acid. Examples of the alcohol are diols such as ethylene glycol, diethylene glycol, triethylene glycol, 1,2-propylene glycol, 1,3-propylene glycol, 1,4-butane diol, neopentyl glycol, 1,4-butene diol, and the like; etherified bisphenols such as 1,4-bis(hydroxymethyl)-cyclohexane, bisphenol A, Hydrogenated bis-phenol A, polyoxyethylated bis-phenol A, polyoxypropylated bisphenol A, and the like; sorbitol, 1,2,3,6-hexanetetrol, 1,4-sorbitane, pentaerythritol, dipentaerythritol, tripentaerythritol, cane sugar, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethylbenzene, and so forth.

Examples of the carboxylic acid are maleic acid fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, maloic acid, 1,4-benzenedilactic acid, 4,4'-propane-dibenzenecarboxylic acid, 1,4-cyclohexanedilactic acid, anhydrides of these acids, dimers of lower alkyl esters and linoleic acid, 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxylpropane, tetra(methylenecarboxyl)methane 1,2,7,8-octanetetracarboxylic acid, enpol trimesic acid, anhydride of these acids, and so forth.

If the polyvalent carboxylic acid is liquid, it can be used as such. If it is solid, it is preferred that the acid is turned into a liquid as a whole, the member coming into direct or indirect contact with the outer circumferential surface of the fixing heat roller is constituted by a liquid supporting member consisting of a porous material or in combination with the liquid supporting member, and the polyvalent carboxylic acid is impregnated into and supported by the liquid supporting member.

In this embodiment, since the polyvalent carboxylic acid oozes out from the internal liquid supporting layer to the outer circumferential surface of the cleaning roller 4, the elasticity of the toner collected on the outer circumferential surface or the toner material deposited thereon is increased at the time of fusing. Accordingly, even when the heater 3 of the heat roller 1 is actuated and the toner material on the cleaning roller 4 is heat-fused, the material is prevented from transferring to the heat roller 1 and hence, further to the pressure contact roller 2 an the occurrence of back contamination is eventually prevented.

Incidentally, the polyvalent carboxylic acid is impregnated into the liquid supporting member in this embodiment.

This embodiment can be practised not only by supplying the polyvalent carboxylic acid to the cleaning member but also by disposing a roller-like member, for example, supporting thereon the polyvalent carboxylic acid so as to face and come into contact with the outer circumferential surface of the fixing heat roller. In such a case, it is preferred to dispose the member supporting thereon the polyvalent carboxylic acid in the range of heat roller upstream of the cleaning range by the cleaning member while facing the heat roller, so that the toner attaching onto the heat roller first comes into contact with the polyvalent carboxylic acid and is then cleaned by the cleaning member.

As described previously, the polyvalent carboxylic acid is used preferably in the form of a liquid as a whole, but in this case, a suitable carrier liquid can be used. The carrier liquid is preferably stable to heat. If the carrier liquid has a mold release property, the effect of preventing the toner of the toner image to be fixed from attaching to the heat roller can be obtained because this carrier liquid is supplied also to the surface of the fixing heat roller, even though in a limited quantity. From this aspect, silicone oil is preferred as the carrier liquid. The proportion of the carrier liquid such as silicone oil to the polyvalent carboxylic acid varies depending upon the kind of the binder resin of the toner, but it is selected from the range of 1:99 to 99:1 and is generally from 95 to 50:5 to 50.

TEST EXAMPLE 7

A modified machine of an electrophotographic reproducing machine, "U-Bix V" (a product of Konishiroku Photo Industry Co., Ltd.) having a carbon steel fixing roller was used for the test. Silicone oil containing 10 wt% of the trimellitic acid was impregnated to the cleaning roller and copying tests were carried out 3,000 times using a two-component system developer composed of a toner consisting principally of a polyester resin.

As a result, hardly any contamination was observed on both surfaces of the resulting 3,000 copies. The toner material on the cleaning roller was solidified after finish of the copying test.

By contrast, copying tests were carried out in the same way except that silicone oil alone was impregnated to the cleaning roller. Back contamination was found on the copies from about 1,500th copies.

What is claimed is:

1. In a method for preventing back contamination by a fixing heat roller employed in a process for fixing a toner image on a supporting member comprising bringing said supporting member bearing an image of toner material comprising a binder resin into pressure contact with said heat roller and heating said heat roller, thereafter cleaning said heat roller with a cleaning member brought into contact with the circumferential surface of said fixing heat roller downstream of the point where at said pressure contact is made, the improvement comprising applying an agent which is capable of enhancing the elasticity of said toner material on said circumferential surface of said fixing heat roller at a point downstream of said point of pressure contact but at or upstream of the point of contact between said fixing heat roller and said cleaning member, whereby transfer of said toner material from said cleaning member to said fixing heat roller is suppressed.

2. The method according to claim 1, wherein said compound is supplied onto the circumferential surface of the fixing heat roller by a member which is directly or indirectly in contact with the circumferential surface of the fixing heat roller and in which said compound is made present.

3. The method according to claim 1, wherein said agent is a material causing a reaction which results in the increase of the molecular weight of a binder resin used in said toner.

4. The method according to claim 3, wherein said toner material comprises as the binder resin a polymer or a co-polymer containing as the main monomer component thereof an acrylic acid ester and the compound is an agent which is capable of enhancing the elasticity of the binder resin, said agent selected from a group consisting of aliphatic amines, quinoline derivatives, piperidine and its derivatives, basic substances containing a nitrogen atom, and a reaction promoter selected from a group consisting of calcium oxide, stearic acid and surfur.

5. In a method for preventing back contamination by a fixing heat roller employed in a process for fixing a toner image on a supporting member comprising bringing said supporting member bearing an image of toner material comprising a binder resin into pressure contact with said heat roller and heating said heat roller, thereafter cleaning said heat roller with a cleaning member brought into contact with the circumferential surface of said fixing heat roller downstream of the point where at said pressure contact is made, the improvement comprising applying a compound selected from the group consisting of (a) polyhydric alcohols, (b) polyvalent amines and (c) polyvalent carboxylic acids on said circumferential surface of said fixing heat roller at a point downstream of said point of pressure contact but at or upstream of the point of contact between said fixing heat roller and said cleaning member, whereby transfer of said toner material from said cleaning member to said fixing heat roller is suppressed.

6. The method according to claim 5, wherein said polyhydric alcohol is ethylene glycol, diethylene glycol, triethylene glycol, tetraethylene glycol, 1,2-propylene glycol, 1,3-propylene glycol, 1,4-butanediol, neopentyl glycol, 1,4-butenediol, sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane or 1,3,5-trihydroxymethylbenzene.

7. The method according to claim 5, wherein said polyvalent amine is selected from the group consisting of ethylenediamine, propylenediamine, tetramethylenediamine, hexamethylenediamine, 1,2,3-triaminopropane, tris(2-aminoethyl)amine, diethylenetriamine, triethylenetetramine, tetraethylenepentamine, bis(4-aminobutyl)amine, bis(5-aminopentyl)amine, p-phenylenediamine, m-phenylenediamine, 2,6-diaminonaphthalene, 2,5-diaminopyridine, 1,4-diaminocyclohexane 1,4-bis(aminoethyl)cyclohexane isopropyl-tris titanic acid ester, 1,3--disiloxane, a monoalkyl substituted product of the amino group thereof and mixtures thereof.

8. In a method for heat fixing a toner image formed on a supporting member by bringing said supporting member bearing said toner image into pressure contact with a fixing heat roller and removing a toner on said fixing heat roller by a liquid supporting member which is in pressure contact with said fixing heat roller, the improvement comprising applying an agent which is capable of enhancing the elasticity of toner material on removed toner on or in said liquid supporting member.

9. In a method for heat fixing a toner image formed on a supporting member by bringing said supporting member bearing said toner image into pressure contact with a fixing heat roller and removing a toner on said fixing heat roller by a liquid supporting member which is in pressure contact with said fixing heat roller, the improvement comprising applying a compound of (a) polyhydric alcohols, (b) polyvalent amines and (c) polyvalent carboxlyic acids on removed toner on or in said liquid supporting member.

* * * * *